US005599206A

United States Patent [19]

Slack et al.

[11] Patent Number: 5,599,206

[45] Date of Patent: Feb. 4, 1997

[54] MODULAR JACK SUBASSEMBLY FOR USE IN A NETWORK OUTLET

[75] Inventors: Victor E. Slack, Lewisville; Rodney E. Reich, Winston-Salem; Mitchell E. Miller, Clemmons, all of N.C.

[73] Assignee: The Whitaker Corporation, Wilmington, Del.

[21] Appl. No.: 511,199

[22] Filed: Aug. 4, 1995

[51] Int. Cl.[6] ..... H01R 13/66

[52] U.S. Cl. ..... 439/536; 439/607

[58] Field of Search ..... 439/536, 535, 439/557, 607, 609

[56] References Cited

U.S. PATENT DOCUMENTS

| | | | |
|---|---|---|---|
| 4,717,358 | 1/1988 | Chaundy . | |
| 4,725,249 | 2/1988 | Blackwood et al. | 439/535 |
| 4,756,695 | 7/1988 | Lane et al. | 439/535 |
| 4,790,769 | 12/1988 | Kanada | 439/536 |
| 4,820,192 | 4/1989 | Denkman et al. | 439/404 |
| 4,874,904 | 8/1989 | DeSanti | 174/53 |
| 4,909,757 | 3/1990 | Reed | 439/532 |
| 5,041,018 | 8/1991 | Arnett | 439/536 |
| 5,074,801 | 12/1991 | Siemon | 439/188 |
| 5,228,869 | 7/1993 | Below | 439/536 |
| 5,228,872 | 7/1993 | Liu | 439/607 |
| 5,238,427 | 8/1993 | Fry et al. | 439/557 |
| 5,295,869 | 3/1994 | Siemon et al. | 439/620 |
| 5,312,273 | 5/1994 | Andre et al. | 439/607 |
| 5,362,254 | 11/1994 | Siemon et al. | 439/536 |

OTHER PUBLICATIONS

Abstract for Application Serial No. 08/403,028; Titled High Performance Shielded Connector; Filed Mar. 13, 1995.

Abstract for Serial No. 08/357,816; Titled Network Interface Assembly and Mounting Frame; Filed: Dec. 16, 1994.

AMP Customer Drawing 555163, dated. Feb. 27, 1987.

*Primary Examiner*—David L. Pirlot

*Assistant Examiner*—Eugene G. Byrd

[57] ABSTRACT

A dual modular jack insert subassembly 10 for use in a network outlet assembly 2 or in a patch panel including a mounting insert 16 to which modular jacks 12 with conventional panel stops 14 are attached without the use of additional fasteners. The mounting insert 16 is a molded member with a front window 20 through which the modular jacks 12 are accessible. Latch arms 18 extend rearwardly from the mounting insert, and a snap fastener 22 located on the inside of each latch arm opposes a window jamb 26 on a side of the window. The panel stops 14 cam the snap fastener 2 outward when the modular jacks 12 are inserted from the rear. The panel stops 14 are positioned in a channel 38 between the snap fastener 22 and a front shoulder 28 when properly mounted on the mounting insert 16.

8 Claims, 6 Drawing Sheets

MODULAR JACK SUBASSEMBLY FOR USE IN A NETWORK OUTLET

BACKGROUND OF THE INVENTION

1. Field of the Invention

This invention is related to the use of electrical connectors, such as standard modular jacks, in data communications networks, such as local area networks. This invention is also related to network outlet assemblies that can be used in such networks and to patch panels that can be used in such networks. More specifically this invention is related to adapter inserts using electrical connectors, such as modular jacks in network outlet assemblies and patch panels.

2. Description of the Prior Art

Data communications networks, such as local area networks used in offices, campuses, and factories require that a large amount of data communications wiring be deployed. Quite often the data communications equipment or data terminal equipment which is used in these networks can change during the life of the facility. However, the wiring installed in the facility can often be used with different types of equipment.

One data communications network interface assembly or data communications outlet assembly which can provide a flexible interface between the installed wiring and various types of communications equipment is disclosed in U.S. Pat. No. 4,756,695. A complementary interface device is disclosed in U.S. Pat. No. 4,986,779. The devices and assemblies disclosed therein each employ a molded plastic frame which can be mounted in a standard wall box or in a wiring closet patch panel assembly. Network wiring connectors and network connector receptacle inserts or adapters can be mounted in these frames to attach the installed wiring to a plug or connector on the communications equipment. The network wiring connectors provide a common interface to shielded twisted pair and unshielded twisted pair data wiring. The network connector receptacle inserts are matable with the network wiring connectors and a family of these inserts provide a number of different receptacles configurations to the data communications equipment. For example, these receptacle configurations include hermaphroditic token ring mating receptacles, modular jack, balun and RS-232 interfaces. These mounting frames also permit coaxial bulkhead connections to be made to bulkhead inserts or adapters which connect directly to coaxial wiring in the wall without the use of the network wiring connector used with discrete wire. Fiber optic assemblies using the same mounting frame are also available.

These mounting frames provide multiple open-ended cavities in which multiple devices, even using different types of wiring, can be installed at a single location, such as in a standard wall box or in a wiring closet patch panel. These mounting frames are integrally molded plastic members with four side walls surrounding the open-ended cavities. Latches and device support members are integrally molded on the walls. The network wiring connector used in those configurations employ insulation displacement connector terminals to provide for simple field termination of data wires. The network wiring connectors edge card connectors with a forwardly facing printed circuit board mating interface, and the network connector receptacle inserts have a printed circuit board interface for mating with these edge card connectors. Thus the edge cards can be easily inserted and removed from their mating configuration with the wiring connector, from the mounting frame and from the assembly. The frame also included screw holes which permit the attachment of a cover to the assembly. The cover includes openings through which the receptacle interface is accessible. The mounting frame also can be plated to provide a shield for applications requiring the use of shielded cable.

U.S. patent application Ser. No. 08/357,816, filed Dec. 16, 1994 discloses a stamped and formed mounting frame that can be used in these applications.

Each of these network outlet assemblies must be suitable for mounting in standard wall boxes, for example standard NEMA boxes. The frame and two interchangeable inserts are typically mounted in these standard wall boxes. The interchangeable inserts must therefore be of uniform size and inserts cannot exceed this standard size if they are to remain interchangeable. In order for these inserts to be economical to produce, the insert subassemblies should also use standard electrical connectors that can be used for other configurations. For example inserts used for twisted pair wire should employ standard RJ-11 or RJ-45 modular jacks. Not only should these modular jacks conform to recognized standards, it is also preferable that the same hardware configuration, that is part numbers, be employed in these inserts as would be employed in other applications. For example, the inserts used in the common commercially available AMP Communications Outlet Assemblies, manufactured by AMP Incorporated and also generally shown in U.S. Pat. No. 4,756,695 and in U.S. patent application Ser. No. 08/357,816 filed Dec. 16, 1994 use printed circuit board modular jack configurations that can be employed in other applications, such as for communications network interface connectors on desktop or personal computers. The modular insert adapter shown in the '695 patent uses a standard panel mount modular jack having conventional panel stops on either side that allow the modular jack to be positioned within a panel opening. The single modular jack adapter shown in this last mentioned patent uses a mounting insert with two integrally molded flexible snaps extending from the rear of the insert on opposite sides of the window opening in which the single modular jack is mounted. These bowed flexible snaps have proven to be easy to manufacture and have facilitated the simple construction of single modular jack inserts. A panel stop modular jack can be easily inserted from the rear and the flexible snaps secure the panel stop modular jack in the single window. However, these bowed flexible snaps are too large to permit their use with dual modular jack inserts that must fit within the same housing or frame compartment. Therefore has been necessary to use an adhesive to secure a dual printed circuit board jack assembly to a mounting insert having an opening large enough to receive two side by side panel stop modular jacks. The space limitations imposed by these modular housing outlet components also preclude using additional hardware to secure dual modular jacks to a mounting insert. For example a mounting clip, of the type shown in U.S. Pat. No. 4,717,358 would require extra space for a dual modular jack insert subassembly that is unavailable.

The modular jacks mounted in housing outlets of the type shown in U.S. Pat. No. 4,756,695 also should be flush with the outlet faceplate or cover. Modular jacks having flexible snaps, such as that shown in U.S. Pat. No. 5,041,018 or those used in commercially available modular telephone keystone jacks are undesirable because they protrude beyond the faceplate or cover.

SUMMARY OF THE INVENTION

A modular jack insert subassembly suitable for use in a modular network outlet assembly or in a patch panel for a network, such as a local area network, uses a conventional modular jack, such as a RJ-45 eight position jack, with a conventional panel stop located on the side of the jack. The mounting insert also includes a mounting insert having a mounting window or opening through which the modular jack is accessible. This mounting insert includes a side post or window jamb on each side of the window. Latch arms extend rearwardly from near the window jambs, and a snap fastener on each latch arm engages a modular jack panel stop after the panel stop cams the snap fastener outwardly during insertion of the modular jack into the mounting insert. This mounting insert in turn mounts the subassembly in a network outlet frame or in a patch panel frame by the use of latch members on the latch arms. The preferred embodiment of this invention is a dual modular jack insert subassembly having two side by side conventional printed circuit board right angle modular jacks with rectangular panel stops on the outer end of the side by side modular jacks. The modular insert can be used either with shielded modular jacks or with unshielded modular jacks. The panel stop on these conventional modular jacks comprises a rectangular molded rib and the mounting insert includes a channel between the snap fastener and a shoulder at the front of the insert. After being snapped past the snap fastener, the panel stop resides in the channel and the modular jacks are secured to the mounting insert. Additional fastening clips and adhesives are not needed and the dual jack can be mounted in the space provided for other modular inserts.

BRIEF DESCRIPTION OF THE DRAWINGS

FIG. 3 is a perspective view showing the rear of a mounting insert that can be used in the dual modular jack insert assemblies shown in FIGS. 1 and 2.

DETAILED DESCRIPTION OF THE PREFERRED EMBODIMENT

Figure 1:
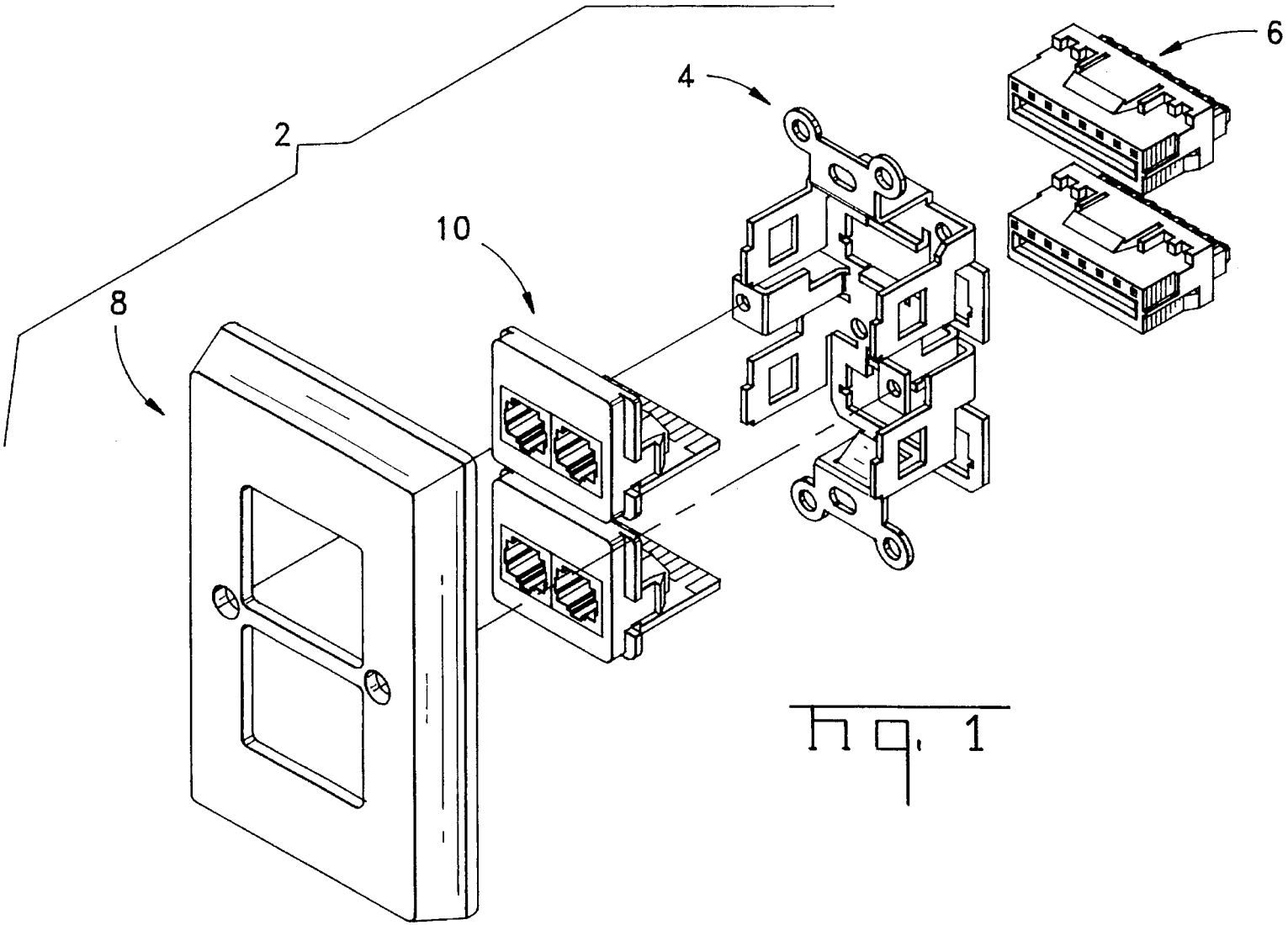
FIG. 1 is an exploded perspective view of a network outlet assembly including two dual modular jack insert subassemblies.

The network outlet assembly 2 shown in FIG. 1 is a modular assembly comprising a mounting frame 4, edge connectors 6, a faceplate 8 and two dual modular jack subassemblies 10. The preferred embodiment of this network outlet assembly 2 serves as an interface point at which data communications equipment can be connected to the wiring in a local area network or other network of electrical components in an office, a factory, a laboratory or other facility. One version of a network assembly of this type is disclosed in U.S. Patent application Ser. No. 08/357,816 filed Dec. 16, 1994 incorporated herein by reference. Another version of this type of network assembly is also disclosed in U.S. Pat. No. 4,756,695 also incorporated herein by reference. These network outlet assemblies provide a convenient way in which the wiring employed in a network can be attached to input and output interface connectors or receptacles or ports to which components such as desktop computers and workstations can be attached. Appropriate modular insert subassemblies are used in these outlet assemblies for interconnection to the physical media or wiring used in a particular installation. For example, a modular jack insert can be used with twisted wires, a coaxial insert with coaxial cable and a fiber optic connector with optical fiber cable. The appropriate insert subassembly is mounted on the mounting frame 4 and connected to the cable. The preferred embodiment of the dual modular jack insert subassembly 10 is a printed circuit board subassembly that is connected to the cable wiring by an edge connector 6. This outlet assembly is mounted in a wall box and a faceplate 8, having openings through which the connector on the insert subassembly is accessible is then attached to the mounting frame 4. These outlet assemblies are typically mounted in a standard wallbox, such as a standard NEMA wiring device box. The entire outlet assembly, excluding of course the faceplate, must be mounted in a standard 16 cu. in. single gang box. These commercially available outlet assemblies also have two insert subassemblies mounted one above the other so that more than one device can be attached or so that more than one cable, cable branch, or type of cable or physical media can be accommodated.

Insert modules or subassemblies, such as the dual modular jack insert subassembly 10 are also used in patch panel assemblies in addition to network outset subassemblies. These patch panel assemblies are typically used in wiring closets or at network hubs and provide connection to the cable at the other end from the outlet subassemblies. Therefore the insert subassemblies must be small enough to fit in standard device boxes and to be used side by side in a patch panel array.

Figure 2:
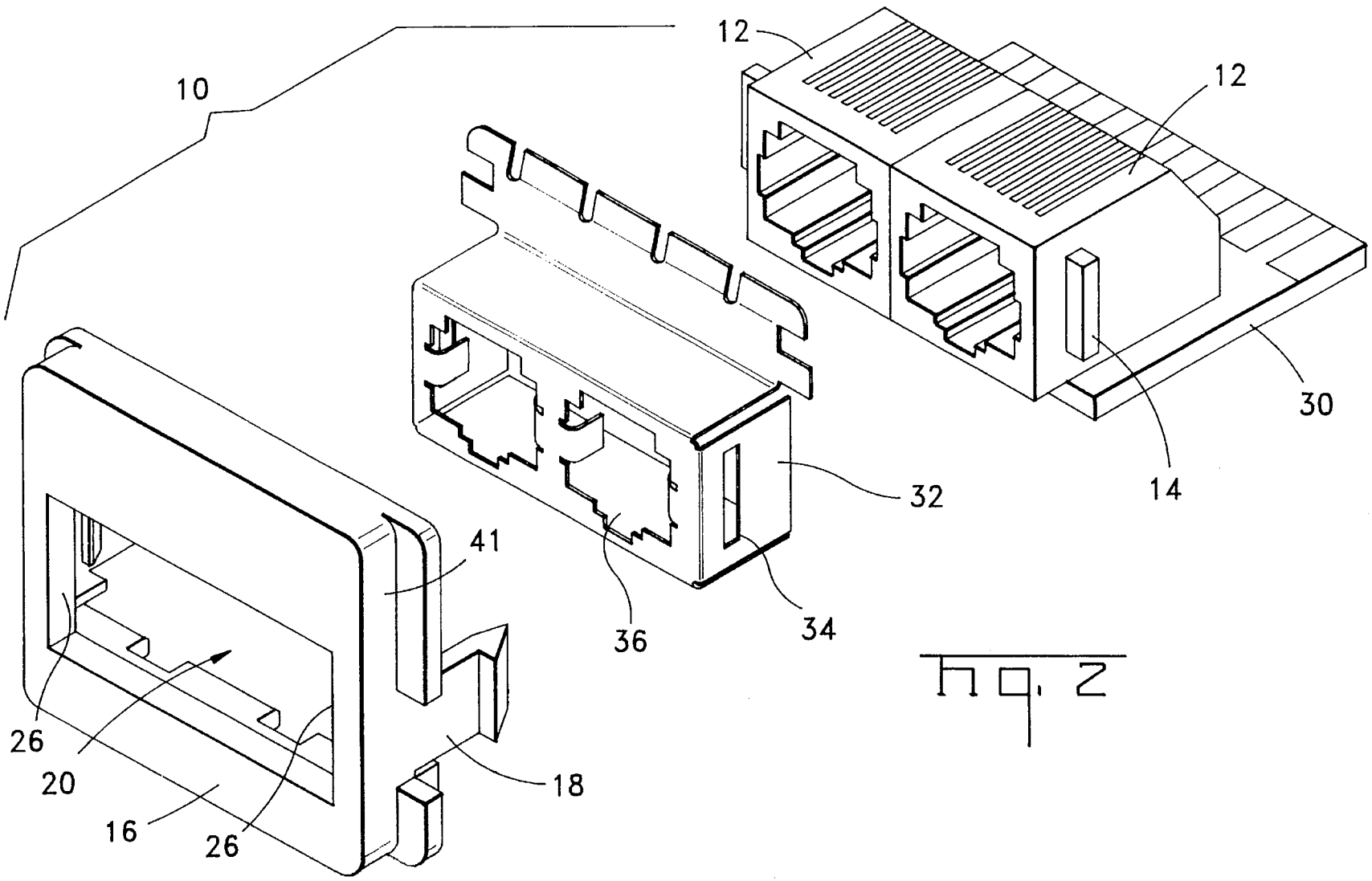
FIG. 2 is an exploded view of a shielded dual modular jack insert subassembly of the type shown in FIG. 1.

One embodiment of the dual modular jack insert subassembly 10 is shown in the exploded view of FIG. 2. This representative view shows the components of a shielded dual modular jack subassembly comprising a pair of printed circuit board modular jacks 12 mounted on a printed circuit board or card 30. A metal shield 32 and a mounting insert 16 comprise the other components of this subassembly. When assembled, the shield 32 surrounds the fronts of the two modular jacks 12 and is positioned between the printed circuit board mounted jacks and the mounting insert 16. An unshielded dual modular jack insert subassembly would use similar printed circuit board jacks and mounting insert 16, but omit the shield 32.

The modular jacks 12 comprise conventional panel stop printed circuit board jacks. Each jack 12 has a panel stop 14 located on one outer side. Conventional individual jacks of this type employ panel stops 14 each side. Two jacks of this type can be mounted side by side, virtually touching, by simply removing the inner panel stops. Alternatively each individual jack housing can be molded with only one panel stop or a two jack housing can be molded as one piece. Panel stops 14 are rectangular molded extensions of the molded jack housing in which jack contact terminals are disposed in a conventional manner. These panel stops are typically used in applications in which a jack is mounted in another component, such as a desktop computer. The panel stops usually engage the cover of a computer or similar device adjacent the opening through which the jack is accessible. In those applications, the panel stop positions the jack in the opening, it provides a mechanical stop to prevent damage to the jack if a modular jack cord is pulled and it also can help position the printed circuit board on which the jack is mounted. These panel stop modular jacks are therefore standard commercially available products that can be economically produced in quantity. Examples of commercially available panel stop modular jacks are AMP Part No. 555162-1 manufactured by AMP Incorporated. For most applications of this type RJ-45 modular jacks having eight contact positions and complying with Subpart F of the FCC-Part 68 Registration Rules are employed. Other modular jack configurations can also be employed such as those suitable for Category 5 applications consistent with ANSI/EIA/TIA-568 (TIA-568) Commercial Building Telecommunications Wiring Standard and supplemental Technical Systems Bulletin TIA/EIA TSB (TSB40) Additional Transmission Specifications for Unshielded Twisted-Pair Connecting Hardware.

Figure 7:
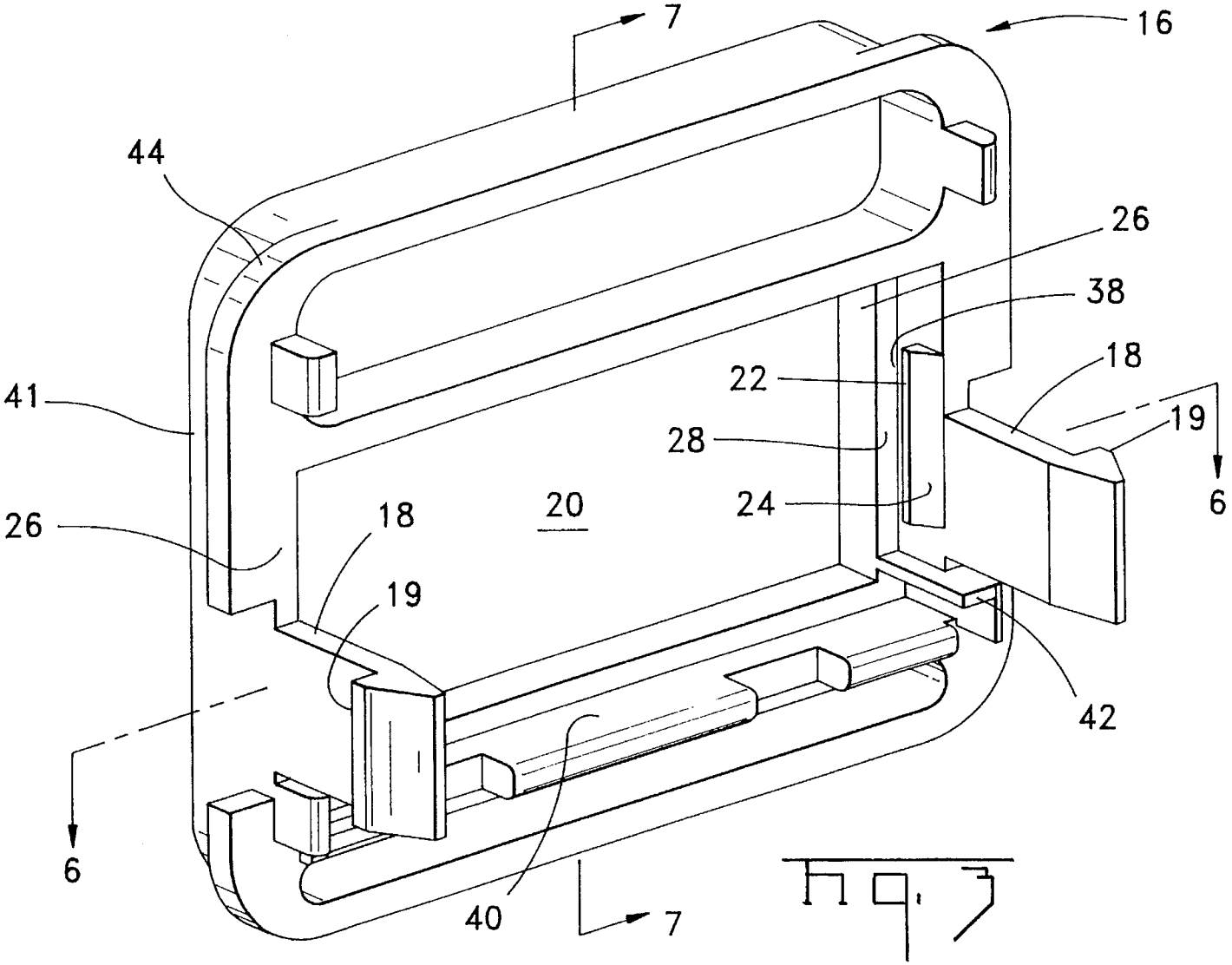
FIG. 7 is a side section view of the mounting insert shown in FIGS. 3 and 6.
Figure 6:
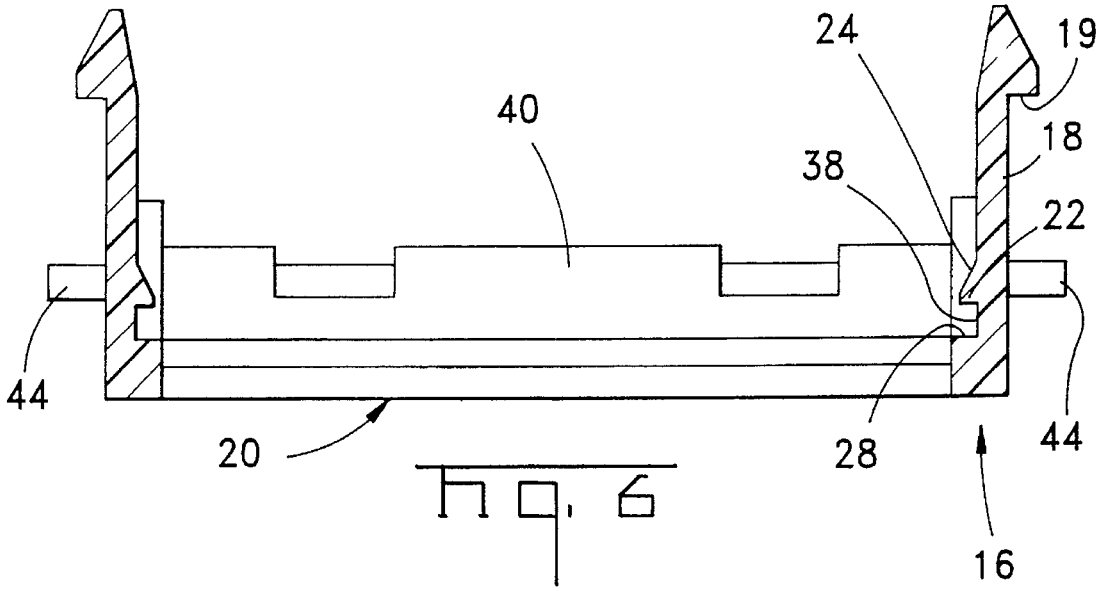
FIG. 6 is a top plan view, partially in section, of the mounting insert shown in FIG. 3.
Figure 7:
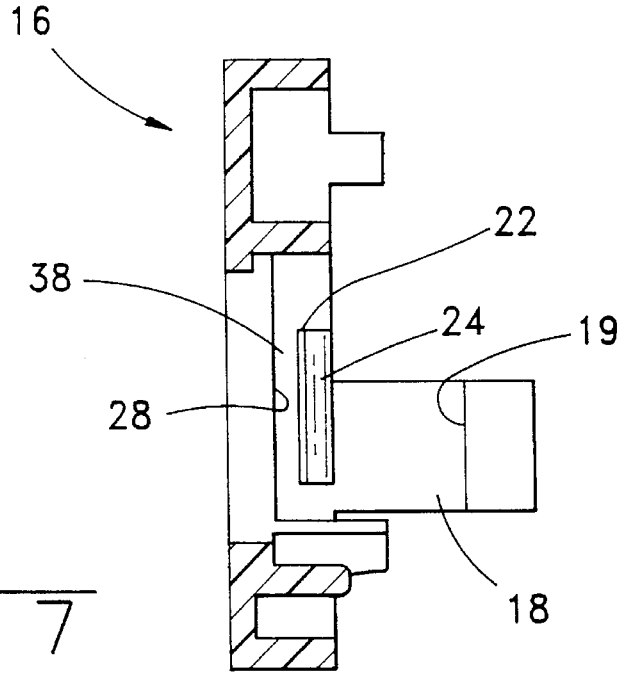

Mounting insert 16 shown in FIG. 3 is a one-piece molded piece is used to mount the dual modular jack printed circuit board insert subassembly 10 to the mounting frame 4. FIGS. 6 and 7 are other views of this mounting insert 16 in which significant structural components are shown. Front portion 41 is mounting insert also fits within openings in the faceplate 8 so that the insert assembly presents a flush appearance in the faceplate openings. A window 20 in the front portion 41 of the mounting insert is dimensioned to receive two side by side modular jacks 12. The lateral dimension of window 20 is slightly less than the lateral dimension of the mounting insert 16 since the combined width of two eight position modular jacks is only slightly less than the spacing between latches 17 that are used to secure the mounting insert subassembly to the mounting frame 4. Side posts or window jambs 26 extend vertically on both sides of the window 20. Mounting insert latch arms 18 extend rearward from the front potion 41 near each of these jambs 26. A rearwardly facing shoulder 28 is located at the back of each window jamb 26, and a snap fastener 22 on each latch arm 18 is spaced from the corresponding shoulder 28 on each jamb. A channel is formed between oppositely facing surfaces on the shoulder 28 and snap fastener 22. The width of this channel 38 is substantially equal to the width of one of the modular jack panel stops 14. The height of the channel 38 is greater than the height of one panel stop 14 so the panel stop can fit securely into this channel. Each snap fastener 22 includes a rearwardly facing inclined surface 24 that cams the snap fastener outward when the outer panel stops 14 on two side by side printed circuit board mounted modular jacks are inserted from the rear. The opposed facing surfaces on the jamb shoulder 28 and on the snap fastener 22 are parallel and extend parallel to the front face of the mounting insert 16 and to the front face of the modular jacks 12, and to the sides of the panel stops 14 when inserted into the channel 38 to secure the panel stops 14 in channels 38. The latch arms 18 are sufficiently flexible so that the snap fasteners 22 may cam outward to permit insertion of the printed circuit board mounted jacks with their panel stops 14 because the mounting insert is molded from a flexible material such as acrylonitrile-butadiene-styrene (ABS).

A ledge 40 is located below the printed circuit board to support the printed circuit board and two inverted L-shaped flanges 42 at opposite sides of the mounting insert 16 provide clearance for portions of printed circuit board 30 that may extend beyond the sides of the modular jacks 12. A lip 44 extends around much of the periphery of the mounting insert 16. This lip 44 will fit behind the faceplate 8. The lip is interrupted on the sides of the mounting insert latch arms 18 to provide clearance for molding these latches. Portions of the snap fasteners 22 extend into this section where the lip 44 is interrupted. This interruption in the lip adds to the flexibility of the latch arms 18, thus making it easier to insert the modular jack panel stops 14.

Each of the latch arms 18 has a latch member 19 at a remote end thereof for securing the insert 16 to the mounting frame 4 of the network outlet assembly which is shown in FIG. 1.

Figure 4:
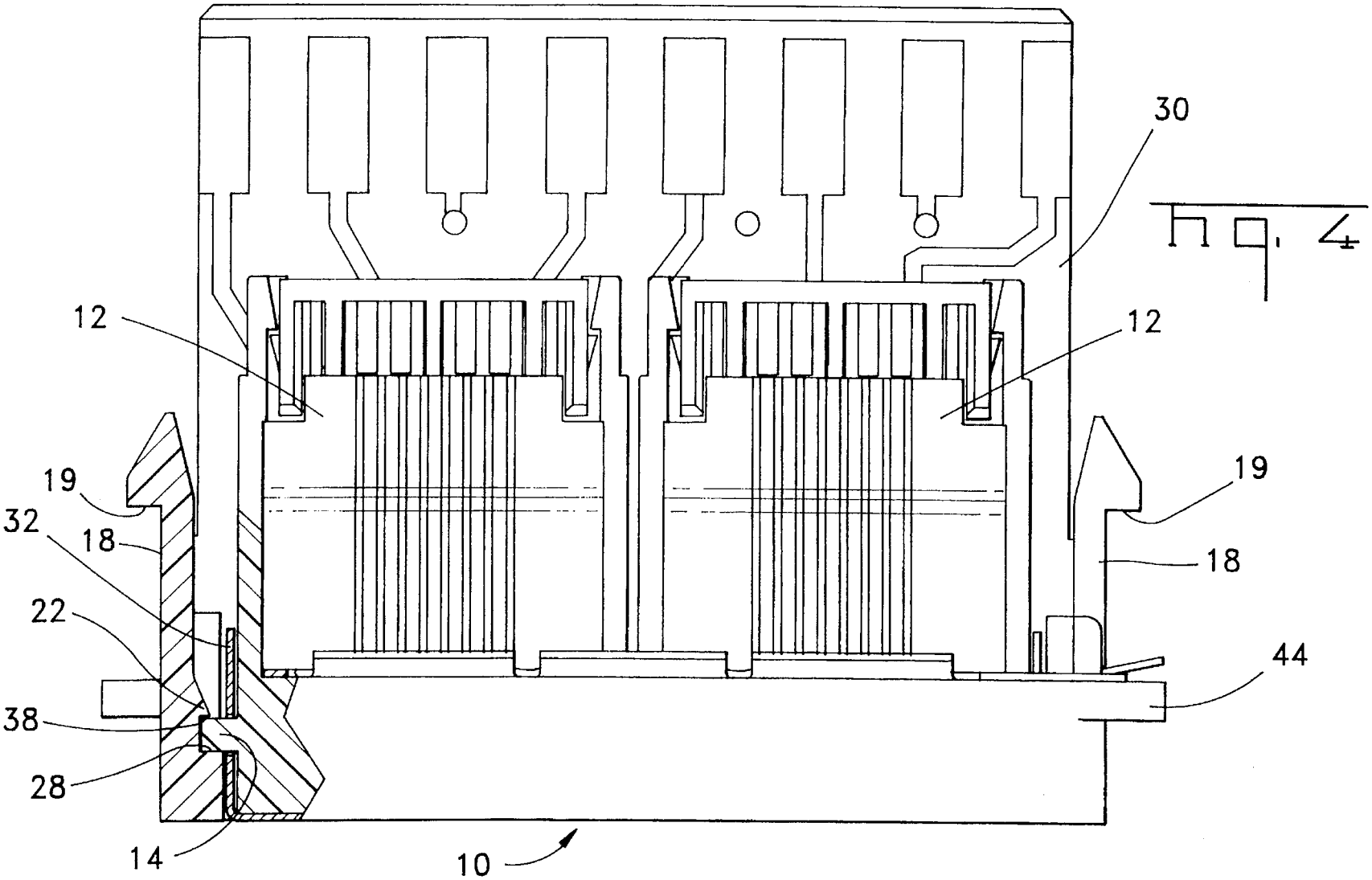
FIG. 4 is a top plan view, partially in section, showing a dual insert subassembly, of the type shown in FIGS. 1 and 2, and showing the manner in which two shielded modular jacks are mounted to the mounting insert shown in FIG. 3.
Figure 5:
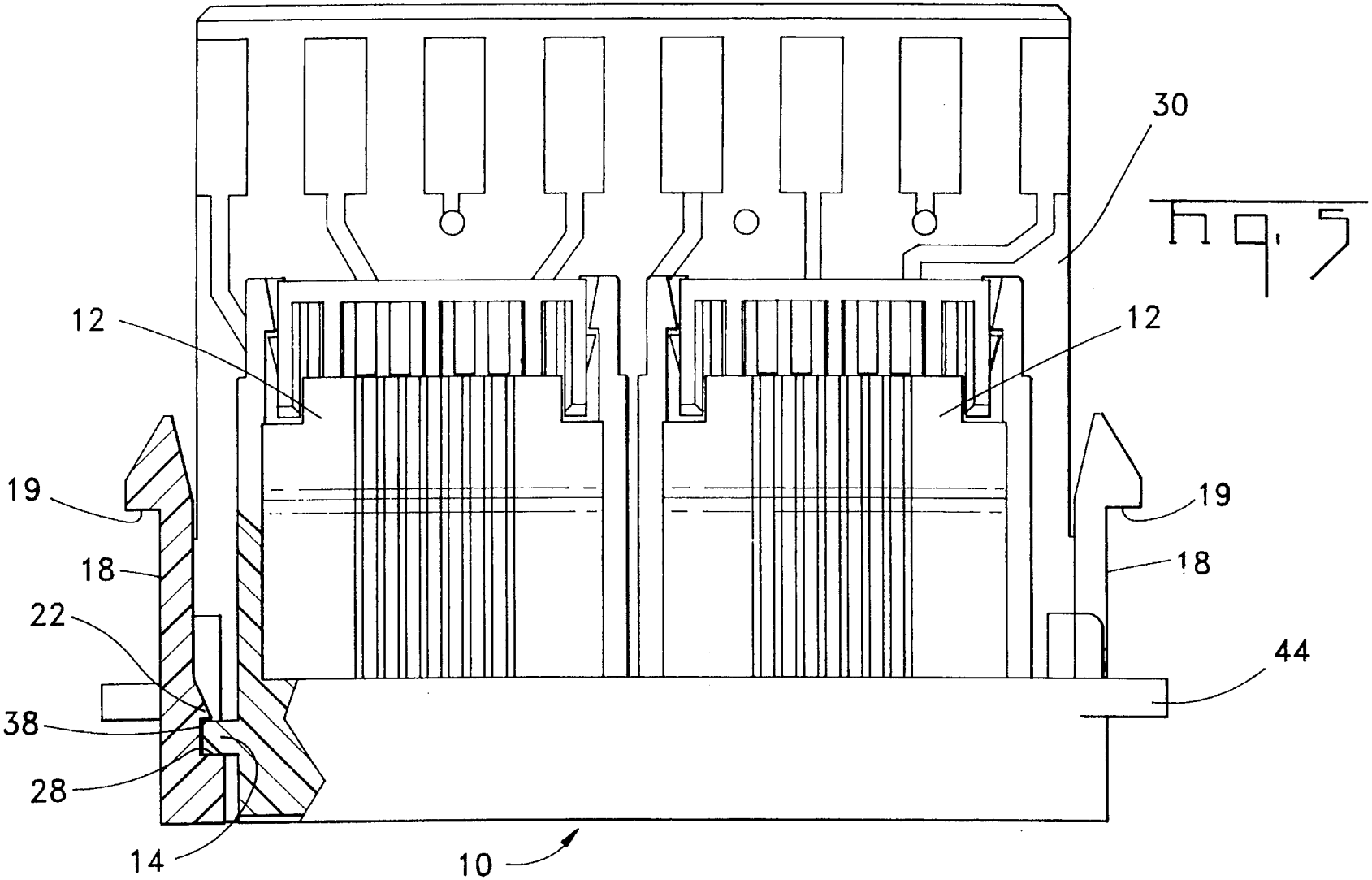
FIG. 5 is a view similar to FIG. 4 showing an unshielded dual insert subassembly.

FIGS. 4 and 5 show two versions of the dual modular jack insert subassemblies 10. FIG. 4 shows a shielded version and FIG. 5 shows an unshielded version. The manner in which the panel stops 14 fit within channels 38 between the shoulder 28 and the snap fastener 22 is shown in the sectioned portion of each figure. As shown in FIGS. 2 and 4 the shield 32 has two panel stop openings 34 through which the panel stops 14 extend. With or without the presence of the shield 32, the panel stops 14 fit in the channel in the same manner. Each of these versions of dual modular jack insert assemblies can be assembled by merely snapping the separate parts together without the need for separate fastening means such as adhesives or clips.

We claim:

1. A modular jack insert subassembly for use in a network outlet assembly comprising:

a modular jack member including a pair of modular jacks each having a respective panel mount stop extending from a respective outer side thereof; and a mounting insert having a front portion defining a window in which a mating face of the modular jack member is positioned, and a pair of resilient latch arms extending rearwardly from the front portion at respective opposite sides of the window, each of the latch arms including a latch member for securing the modular jack insert in the network outlet assembly, and an inwardly facing snap fastener, the snap fasteners being outwardly deflectable upon engagement with respective ones of the panel mount stops during insertion of the modular jack member into the mounting window from the rear, wherein upon complete insertion of the modular jack into the mounting window, the snap fasteners resile behind the panel mount stops to prevent withdrawal of the modular jack from the mounting insert.

2. The modular jack insert subassembly according to claim 1, wherein the front portion defines a rearwardly facing shoulder which cooperates with the snap fasteners to capture the panel mount stops therebetween.

3. The modular jack insert subassembly according to claim 2, wherein the rearwardly facing shoulder includes a pair of shoulder surfaces adjacent to respective ones of the latch arms.

4. The modular jack insert subassembly according to claim 1, wherein each said snap fastener includes an inclined camming surface which is engaged by a respective said panel mount stop during insertion of the modular jack into the window.

5. The modular jack insert subassembly according to claim 1, wherein each said modular jack is mounted on a printed circuit board.

6. The modular jack insert subassembly according to claim 1, further comprising a shield on the exterior of the modular jacks between the modular jacks and the mounting insert, the shield including openings through which the panel mount stops protrude.

7. The modular jack insert subassembly according to claim 1, wherein a front of each modular jack is flush with a front of the mounting insert.

8. A network outlet assembly comprising:

a mounting frame mountable in a standard wall box;

a faceplate for use with the wall box and attachable to the mounting frame and having at least one faceplate opening; and a modular jack insert subassembly for use in the network outlet assembly, the modular jack insert subassembly comprising:

a modular jack member including a pair of modular jacks each having a respective panel mount stop extending from a respective outer side thereof; and a mounting insert having a front portion defining a window in which a mating face of the modular jack member is positioned, and a pair of resilient latch arms extending rearwardly from the front portion at respective opposite sides of the window, each of the latch arms including a latch member for securing the modular jack insert in the network outlet assembly, and an inwardly facing snap fastener, the snap fasteners being outwardly deflectable upon engagement with respective ones of the panel mount stops during insertion of the modular jack member into the mounting window from the rear, wherein upon complete insertion of the modular jack into the mounting window, the snap fasteners resile behind the panel mount stops to prevent withdrawal of the modular jack from the mounting insert.

* * * * *